United States Patent [19]

Dinsmore

[11] Patent Number: 4,548,447

[45] Date of Patent: Oct. 22, 1985

[54] ELECTRICAL JACK

[75] Inventor: Jeffrey P. Dinsmore, Excelsior, Minn.

[73] Assignee: Magnetic Controls Company, Minneapolis, Minn.

[21] Appl. No.: 597,244

[22] Filed: Apr. 5, 1984

[51] Int. Cl.[4] ..... H01R 4/66

[52] U.S. Cl. ..... 339/14 R; 339/17 C; 339/182 R

[58] Field of Search ..... 339/17 C, 182, 183, 339/17 R, 14 R; 200/51.1

[56] References Cited

U.S. PATENT DOCUMENTS

| | | | |
|---|---|---|---|
| 3,133,703 | 5/1964 | Monroe . | |
| 3,524,108 | 8/1970 | English | 339/17 C X |
| 3,822,415 | 7/1974 | Deitch | 339/17 R |
| 3,949,180 | 8/1976 | Ojama et al. | 200/51.1 |
| 4,165,147 | 8/1979 | Buck | 339/17 C X |
| 4,364,625 | 12/1982 | Baker et al. . | |
| 4,392,708 | 7/1983 | Bailey et al. | 339/182 R |

*Primary Examiner*—Eugene F. Desmond

*Attorney, Agent, or Firm*—Merchant, Gould, Smith, Edell, Welter & Schmidt

[57] ABSTRACT

An electrical jack (10) for use on a circuit board (47) is disclosed. Jack (10) has vertically stacked receiving passages (14) and (16) for plugs (18) and is protected against dust and other environmental contaminants by a cover (30). Jack (10) includes a common sleeve spring (20) for both plugs (18). First and second switching mechanisms (22, 24) function with lower plug (18), while third and fourth switching mechanisms (26, 28) function with higher plug (18). Lower ring and tip springs (116, 120) provide contact force about orthogonal tension axes. Pairs of retention lugs (122, 164) cooperate to hold jack (10) to circuit board (47).

13 Claims, 7 Drawing Figures

FIG. 7

ELECTRICAL JACK

FIELD OF THE INVENTION

The present invention is directed to an electrical jack and, more particularly, to a jack for use on circuit boards to provide electrical continuity between conductive paths on the circuit board and plugs inserted into the jack.

BACKGROUND OF THE INVENTION

Electrical jacks for mounting on a printed circuit board are known in the prior art. There are jacks which have contact elements parallel with the axis of a mounted plug. There are also jacks having at least the lug portions of contact elements perpendicular to the axis of a mounted plug. Furthermore, there are jacks of both types designed for receiving multiple plugs. Known multiple plug jacks, however, require side-by-side plug insertion, generally due to the structure of the contact springs. Consequently, known multiple plug jacks tend to occupy a relatively large space on a circuit board.

SUMMARY OF THE INVENTION

The present invention is directed to a jack which occupies a relatively small space on a circuit board by having vertically stacked receiving passages for multiple plugs. The jack includes a non-conductive housing having a center plane which is substantially perpendicular to the bottom wall of the jack. As indicated, the jack includes a plurality of receiving mechanisms for plugs. The receiving mechanisms are stacked along the center plane. In addition, the jack has spring mechanisms for providing continuity between conductive paths on the circuit board and the plugs, as well as mechanisms for fastening the springs to the housing.

In more detail, one embodiment of the present invention includes a housing having a base and front and rear structures rising from the base. The front structure includes upper and lower passages for receiving upper and lower plugs. At one side of the front structure, there are facing grooves forming a pocket for a common sleeve spring having upper and lower spring elements for contacting the sleeves of the upper and lower plugs. The sleeve spring usually provides a common ground element for both plugs. The jack also includes first and second switch mechanisms for both the upper and lower plugs. The first and second switch mechanisms are functioned by the lower plug and are located on a first side of the center plane, while the third and fourth switch mechanisms are functioned by the upper plug and are located on a second side of the center plane. A cover having fastening mechanisms at both the front and rear of the housing shields the switch mechanisms from dust and other detrimental environmental factors.

The present jack is particularly important because of its compact profile which includes vertically-stacked plugs. The compact profile is possible because of the advantageous relationship of the common sleeve spring and a pair of switching mechanisms on each side of the center plane of the housing with one pair being operable by contact portions located below a contact plane on which all switching contactors are substantially centered, while the other pair has contact portions located above the common contactor plane.

Further advantage results from the use of a single sleeve spring as a common ground element for both upper and lower plugs. The single sleeve spring is located on one side of the center plane in line with the springs of the switching mechanisms along that side. A similar location on the other side of the center plane is free of contact springs and available for the tongue and groove locking mechanism of the dust cover. Significantly, in combination with this forward locking mechanism, the dust cover may be positively locked to the housing by using a block and loop lock mechanism at the rear of the housing.

The springs used for the switching mechanisms for the upper plug have length so that cantilever spring action provides sufficient contact force between the contactors of the springs of a switching mechanism or between a spring and a plug. The present invention, however, solves the problem of providing an adequate amount of force between the contactors of the springs of the switching mechanisms for the lower plug. The contact ring and tip springs for the lower plug not only utilize spring force due to a cantilever design, but also combine a torsional force about an axis orthogonal to the axis about which the cantilever bending occurs.

The present invention is of still further advantage in that lugs from the springs of the switching mechanisms from one side of the center plane may be paired with lugs of the switching mechanisms from the other side of the center plane to provide lug pairs for retaining the jack to the circuit board. The retention pairs are advantageously shaped to provide a sensory response to the person inserting the jack into the hole pattern so that he knows when the jack has been received by the circuit board. Furthermore, the lug shape provides for a lesser force during insertion than for removal so that jack is relatively easy to insert, but somewhat more difficult to remove.

Thus, the present jack provides a compact device for connecting plugs to a printed circuit board. This important feature has resulted in a large number of advantages as indicated briefly hereinbefore. These advantages and other objects obtained by the present invention are further explained and may be better understood by reference to the sketches and descriptive matter hereinafter. A preferred embodiment of the invention is shown and described. It is understood, however, that the embodiment is exemplary and that the invention may be practiced to the full extent of the general meaning of the terms of the appended claims.

DETAILED DESCRIPTION OF THE PREFERRED EMBODIMENT

Figures 1, 7:
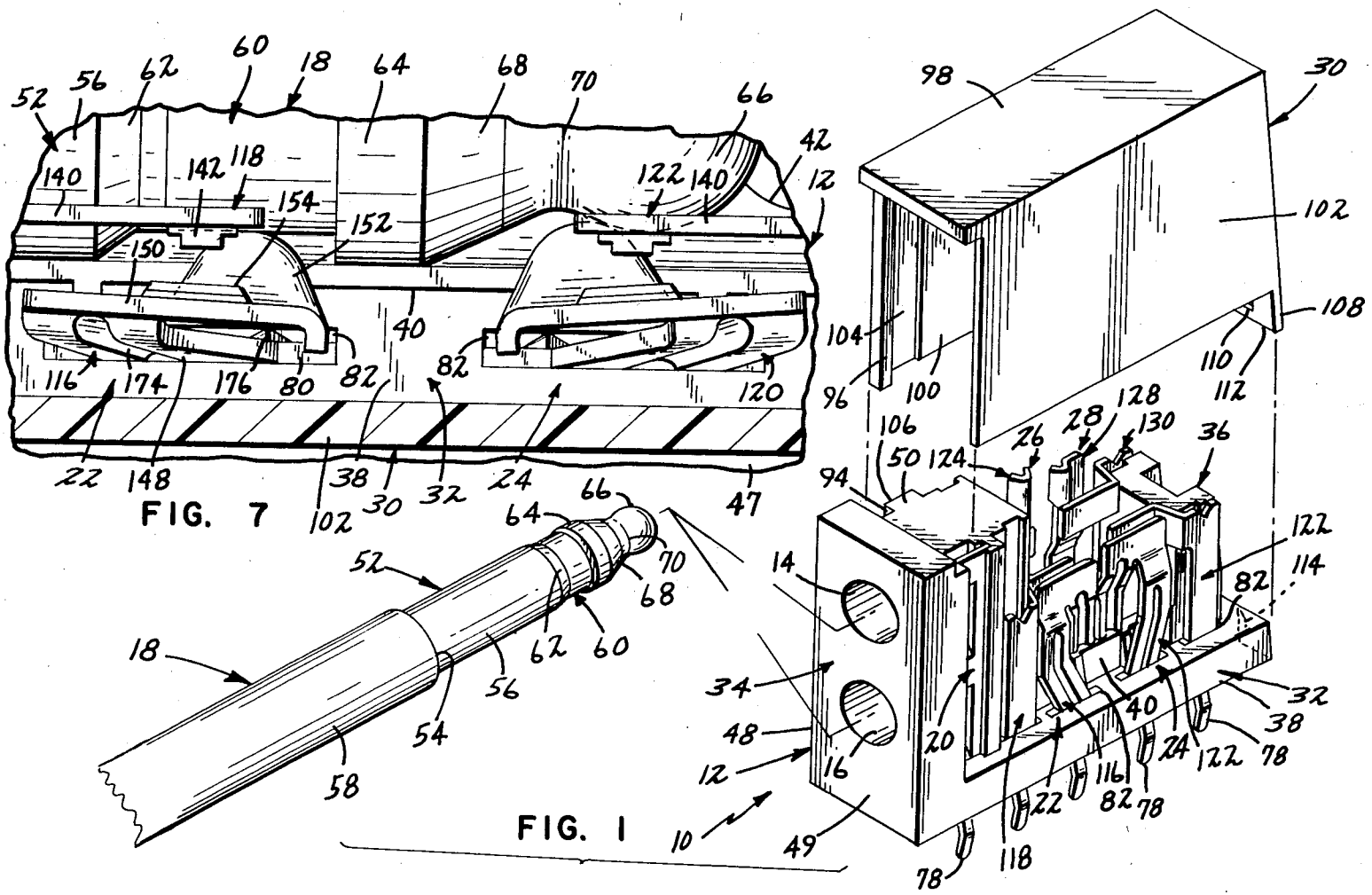
FIG. 1 is an exploded perspective of a plug, jack and cover in accordance with the present invention.
FIG. 7 is a detailed top view of the lower ring and tip springs as bent away from the normal springs by the lower plug.

Referring now to the drawings wherein like reference numerals designate identical or corresponding parts throughout the several views, and more particularly to FIG. 1, a jack in accordance with the present invention is designated generally by the numeral 10. Jack 10 includes housing 12 having upper receiving passage 14 and lower receiving passage 16 for a plug as shown at 18. Jack 10 further includes sleeve spring 20, used generally as an electrical ground, and first, second, third and fourth switching mechanisms 22, 24, 26 and 28. Cover 30 protects the electrical elements from dust and other environmental contaminants.

Figure 2:
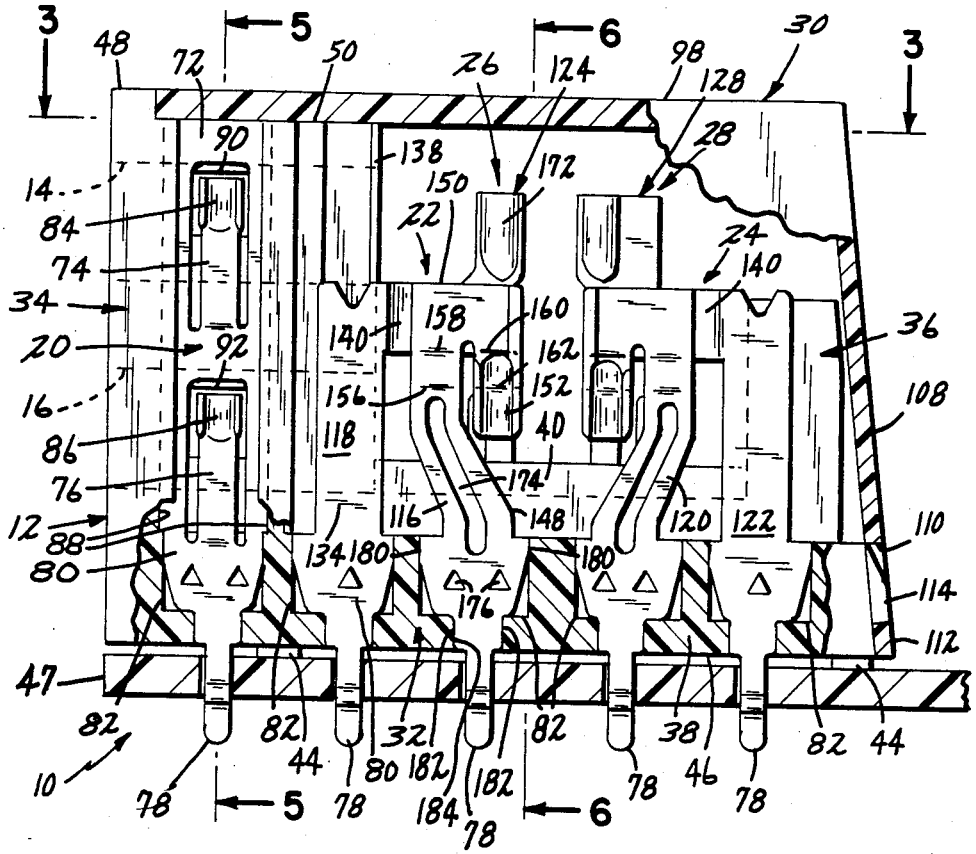
FIG. 2 is a side elevational view, with portions broken away, of a jack inserted into a circuit board.
Figure 3:
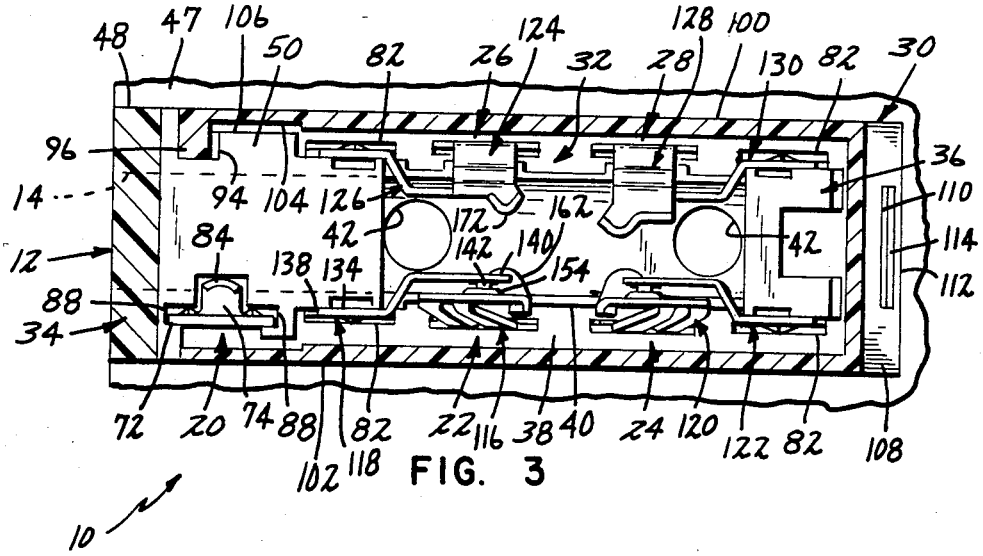
FIG. 3 is a top view in cross section taken along line 3—3 of FIG. 2 with no plugs inserted.
Figure 4:
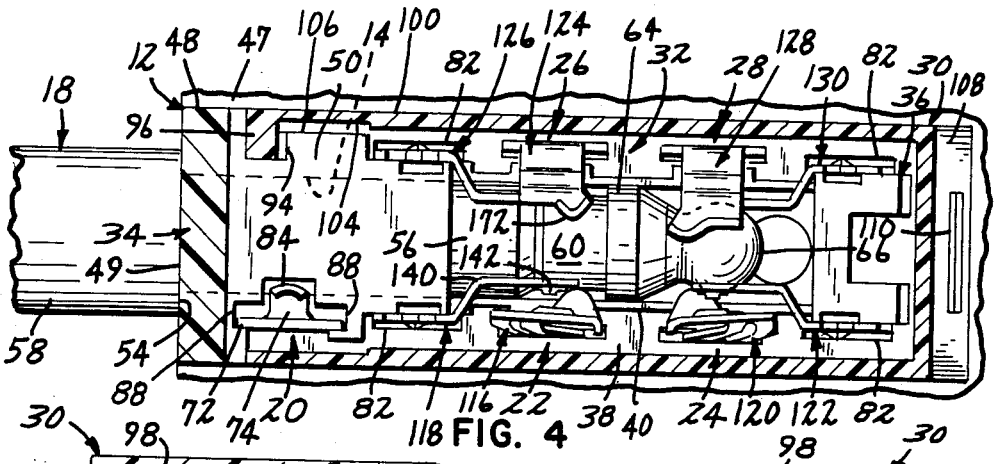
FIG. 4 is a view similar to FIG. 3 showing a lower plug inserted.

Housing 12 is made from a non-conducting material and includes a base portion 32 from which a forward structure 34 and a rear structure 36 rises. Base 32 has a wider, lower portion 38 and a narrower, upper portion 40. Upper portion 40 is formed with a semi-cylindrical top side for cradling the lower plug. A plurality of slots 82 are located in lower portion 38 slightly outwardly from each side of upper portion 40. The slots are shaped to receive the mid-portions of the several springs as described hereinafter. One or more openings 42, as shown in FIG. 3, for drainage of cleaning fluids, pass vertically through the center plane of both upper and lower portions 38 and 40. Standoffs 44 protrude from bottom side 46 near both the forward and rearward ends of housing 12 to hold the bottom side somewhat off circuit board 47 (see FIG. 2).

Forward structure 34 includes upper passage 14 and lower passage 16 as indicated hereinbefore. Passages 14 and 16 are cylindrical and have a diameter only slightly greater than the smaller diameter portion 56 of sleeve 52 of plug 18. Passages 14 and 16 are centered on the vertical, center plane of housing 12 which is perpendicular to bottom wall 46. Forward structure 34 has an outer portion 48 which is the same width as lower portion 38 of base 32 and rises approximately the thickness of cover 30 above the inner portion 50 of forward structure 34. Forward structure 34 has sufficient thickness to provide support structure for sleeve spring 20 and normal springs 118 and 126, as well as relatively solid support for upper and lower plugs 18.

Plug 18 is representative of the type of plug used with jack 10. Plug 18 includes sleeve 52 having a shoulder 54 separating an insertable, smaller diameter portion 56 from an uninsertable, greater diameter portion 58. Shoulder 54 butts against front wall 49. Sleeve 52 is tubular and contains a smaller diameter tube therewithin, the end of which forms ring 60. The tubes of sleeve 52 and ring 60 are separated by a non-conducting material 62. Ring 60 has an end portion 64 of greater diameter, which is approximately the same diameter as lesser diameter portion 56 of sleeve 52. A cylindrical rod having ball 66 at its end is axially contained within the tube of ring 60. The rod of ball 66 is separated from the tube of ring 60 by non-conductive material 68. Materials 62 and 68 may be different and separated, but are generally the same material and are connected. A neck portion 70 separates ball 66 from non-conducting material 68. The ball 66, ring 60, and sleeve 52 portions of plug 18 may be electrically connected to elements of an electrical circuit (not shown).

Figure 5:
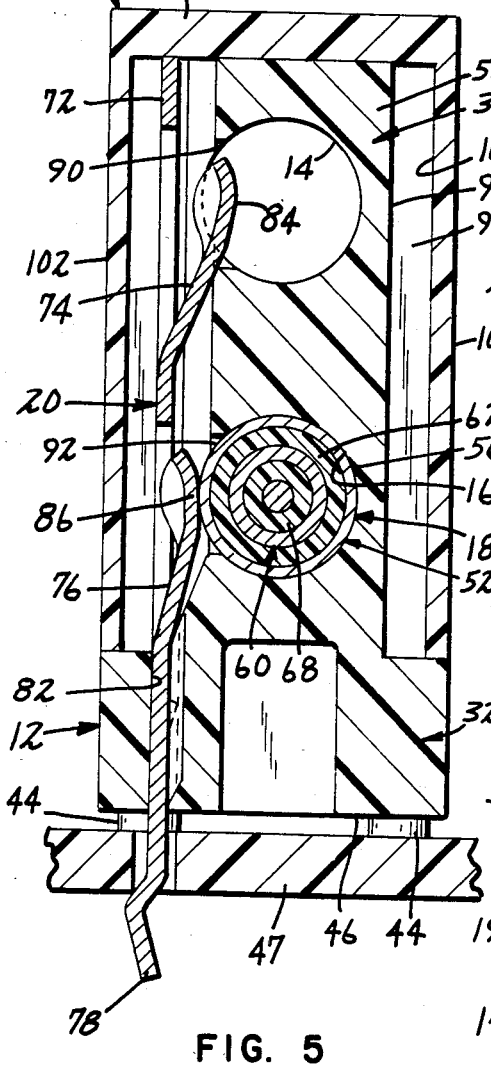
FIG. 5 is a cross-sectional view taken along line 5—5 of FIG. 2.

Sleeve spring 20 is received in structure just behind outer portion 48 of forward structure 34 along a first side of inner portion 50. Sleeve spring 20 is shown most clearly in FIGS. 2 and 5. Sleeve spring 20 is made from a flat plate of conducting material. Spring 20 includes an upper portion having a frame 72 with upper spring element 74 and lower spring element 76. The lower portion of spring 20 includes lug 78 and mid-portion 80 formed for fastening engagement with forwardmost slot 82 on the first side of the lower portion 38 of base 32 of housing 12. Each of spring elements 74 and 76 is centered on strip 20 and is bordered on the top and sides by a slot separating it from frame 72. Each of spring elements 74 and 76 is bent inwardly at the connecting line with frame 72. Thereafter and proceeding upwardly, each element 74 and 76 is again bent so that its contact portion 84, 86 is approximately parallel with frame 72. Contact portions 84 and 86 are formed with a detent in the outer sides so as to shape the inner sides arcuately for contact with sleeve 52.

Sleeve spring 20 is retained by a pair of spaced-apart, facing grooves 88 forming a pocket in inner portion 50 of housing 12 as shown in FIG. 3. Upper opening 90 and lower opening 92 are provided for contact portions 84 and 86 to extend through to contact a plug 18. When a plug 18 is inserted so as to function spring element 74 or 76, grooves 88 provide support to counteract the spring force between frame 72 and the particular spring element 74 or 76. The outermost side of sleeve spring 20 from the top of forward structure 34 to lower portion 38 of base 32 may be covered by a wall extending between grooves 88 or may be open as shown in FIG. 3.

A vertical slot 94 is formed in inner portion 50 of forward structure 34 on the sidewall opposite from sleeve spring 20. Groove 94 is formed to receive the matching tongue 96 (see FIG. 1) of cover 30. Cover 30 has a top 98 with a sidewall 100 having tongue 96 at its forward end and a sidewall 102 opposite therefrom. Sidewall 100 also includes a wide slot 104 for receiving mating surface 106 adjacent to groove 94. A back wall 108 extends downwardly from top 98 and extends below both sidewalls 100 and 102. At the lower end of back wall 108 there is an opening 110 with essentially a loop 112 of material thereabout. A protruding block 114 is located centrally on the backside of lower portion 38 of base 32. Loop 112 and block 114, engage in cooperation with tongue 96 and groove 94 to hold cover 30 to jack 10.

The first switching mechanism 22 includes lower ring spring 116 and a first normal spring 118. The second switching mechanism 24 includes a lower tip spring 120 and a second normal spring 122. The third switching mechanism 26 includes an upper ring spring 124 and a third normal spring 126 (see FIG. 3). The fourth switching mechanism 28 includes an upper tip spring 128 and a fourth normal spring 120. Because of the symmetry of the design, second normal spring 122 and third normal spring 126 are identical, while first normal spring 118 and fourth normal spring 130 are identical. Each indicated set of normal springs, furthermore, is similar except the lugs 78 and the horizontal portions 140 have bends in directions opposite from the other since on each side of the center plane of jack 10, one normal spring has horizontal portion 140 pointing forwardly, while the other normal spring has horizontal portion 140 pointing rearwardly.

Normal spring 118 is representative of the other normal springs 122, 126, and 130. As shown in FIGS. 2 and 3, normal spring 118 is a flat strip of conducting material and includes a lug 78, a vertical portion 134 with a mid-portion 80 for fastening spring 118 to base 38 there-between. Lug 78 and fastening mid-portion 80 are discussed in more detail hereinafter. Vertical portion 134 extends upwardly to approximately the lower edge of upper passage 14 of housing 12. Vertical portion 134 is in contact with and is supported by the flat surface or by ridges or other standoff shapes on sidewall 138 of forward structure 34 of housing 12. In like fashion, the vertical portions of the other normal springs are also supported appropriately by sidewalls of either rear structure 36 or forward structure 34. Horizontal portion 140 extends away from vertical portion 134 toward the appropriate mating spring, in this case, lower ring spring 116. Horizontal portion 140 is bent inwardly and again outwardly so that the end part of horizontal portion 140 is located inwardly from, but essentially parallel to, the flat surface of the supported vertical portion 134. A contact 142 made from, for example, a gold, platinum, and silver alloy is attached to the outer surface near the end of horizontal portion 140.

In like fashion, lower ring spring 116 and lower tip spring 120 are similarly configured except each faces in opposite directions from the other so that bends in each are opposite from the other. Nevertheless, ring spring 116 is hereinafter described and is also representative of the structure of tip spring 120. As shown in FIGS. 1–3 and 6, lower ring spring 116 is a flat strip of conducting material and includes a lug 78 extending below mid-portion 80 which includes mechanism for fastening spring 116 to base 32 as described hereinafter. Cantilever portion 148 rises above mid-portion 80 to a connect portion 150 beneath which contact portion 152 extends downwardly. Cantilever portion 148 is connected to mid-portion 80 symmetrically with respect to a centerline bisecting lug 78 and mid-portion 80. Thereafter, however, cantilever portion 148 is shaped so as to incline toward normal spring 118 before inclining again vertically parallel to the center line of spring 116. Connect portion 150 extends horizontally in a direction away from normal spring 118. Connect portion 150 connects cantilever portion 148 with contact portion 152. The upper edge of connect portion 150 is approximately the same height as the upper end of vertical portion 134 of normal spring 118. Contact portion 152 extends downwardly not quite half the distance from connect portion 150 to mid-portion 80. Cantilever portion 148 is inclined sufficiently toward normal spring 118 so that the outer edges of the upper portion of cantilever portion 148 and contact portion 152 are approximately in line with the outermost edges of mid-portion 80.

Lower ring spring 116 provides a spring force between contactor 142 of normal spring 118 and contactor 154, which is attached to connecting portion 150 in an orientation preferably perpendicular to contactor 142. Lower ring spring 116 also provides a spring force between contact portion 152 and ring 60 of plug 18 when plug 18 is inserted in lower passage 16. Near its upper end, cantilever portion 148 is bent inwardly and again outwardly, e.g. at 156 and 158, so that connecting portion 150 is approximately parallel with but inward from cantilever portion 148. Connect portion 150 is located sufficiently inwardly so as to provide a small force between contactors 142 and 154. That is, horizontal portion 140 of normal spring 118 is forced slightly inwardly by the cantilever spring action and also to some extent by torsional force about a vertical axis as discussed more hereinafter.

Contact portion 152 extends further inwardly from connect portion 150 with bends at 160 and 162. The lower part of contact portion 152, is inclined somewhat with respect to the plane of mid-portion 80, but on contact with sleeve 60 of plug 18 is approximately parallel with mid-portion 80. As with the contact portions 84, 86 of spring elements 74, 76, contact portion 152 is formed with a detent in its outer side so as to shape the inner side arcuately for better contact with ring 60. Since contact portion 152 is considerably inwardly from the plane of mid-portion 80 and since contact portion 152 is offset from cantilever portion 148, contact by mid-portion 80, with ring 60 causes a springing action both by cantilever portion 148 with respect to mid-portion 146, i.e., about a horizontal axis, and by contact portion 152 with respect to cantilever portion 148, i.e., about a vertical axis. The combined spring force provides more force than would otherwise be available due to simply a cantilever action and provides sufficient force to essentially eliminate contact bounce or other problems associated with contacts when insufficient force exists between the contacts. In addition, a further advantage results from the present configuration. As contact portion 152 is bent outwardly by plug 18, the horizontal portion 140 of sleeve spring 118 also moves somewhat outwardly. Horizontal portion 140 and connect portion 150, however, are moving about different axes and, consequently, there is sliding between contactors 142 and 154. The sliding action thereby cleans and keeps clean the facing surfaces of the contactors.

As indicated previously, lower tip spring 120 is configured similar to lower ring spring 116 and functions in a similar fashion with respect to normal spring 122 and the ball 66 of a lower plug 18.

Figure 6:
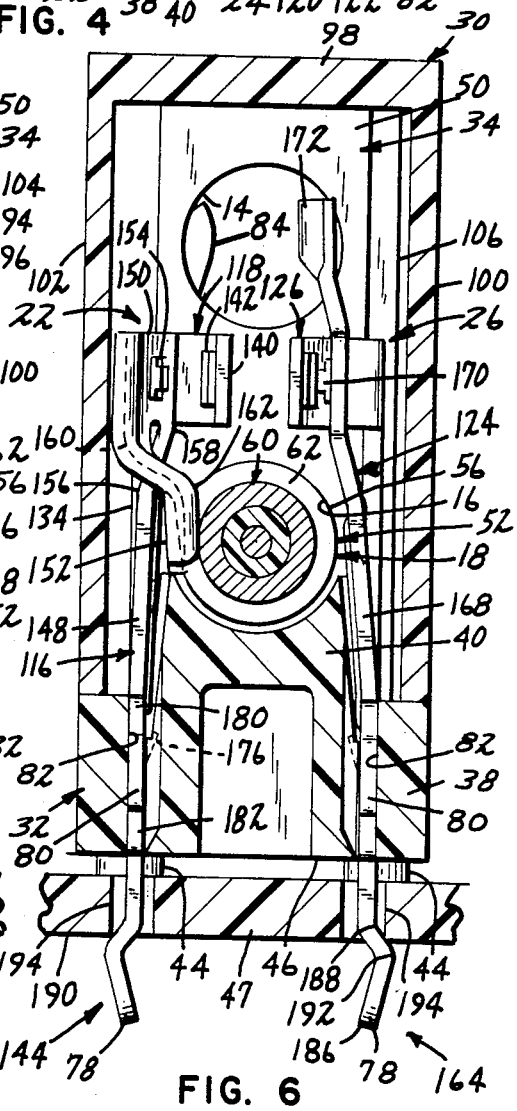
FIG. 6 is a cross-sectional view taken along line 6—6 of FIG. 2.

Upper ring spring 124 and upper tip spring 128 are shaped somewhat differently than each other, but, as shown in FIG. 6, essentially include a lug 78 connected by a mid-portion 80 to a cantilever portion 168. A contactor 170 is fastened to cantilever portion 168 approximately centered on the contactor plane. Cantilever portion 168 extends above the contactor plane and includes an arcuately shaped end 172 for contacting plug 18.

Also, it is noted that the structural strength of each of the cantilevered portions of the upper and lower ring and tip springs is enhanced with an indented groove on the outer side with a corresponding protruding groove on the inner side as shown, for example, at 174 of lower sleeve spring 116.

As indicated previously, the mid-portions 80 and the lugs 78 are substantially the same for the several springs. Mid-portion 80 of lower ring spring 116 is typical. Mid-portion 80 includes two triangular detents 176 with corresponding protuberances. Each detent 176 has an apex angle pointing upwardly or in the general direction of contactor 154. The protruded portion provides a friction fit between the inner and outer walls of slot 82. Mid-portion 80 also includes two pair of spaced apart, parallel edges 180, 182, for fitting tightly against the edges of slot 82. Edges 180 are nearest cantilever portion 148 and have the wider separation. Edges 182 are nearest lug 78 and fit within a narrower portion 184 of slot 82. Both pairs of edges 180 and 182 may fit snugly within slot 82 or may actually form an interference fit. Detents 176 and the corresponding protruding portion in combination with the pairs of parallel edges 180 and 182 provide a frictional fastening mechanism to hold spring 116 to housing 12. It is understood, however, that the fastening mechanism is representative with respect to other features of the springs and as a unique feature itself may be altered. For example, the normal springs are shown to have only one detent like 176.

At least one lug 78 near the forward end and one lug 78 near the rearward end on each side of the center plane of jack 10 are shaped as shown in FIG. 6. All of the lugs on one side of this center plane may be shaped identically, while all the lugs on the other side of the center plane may also be shaped identically but with bends in opposite directions from those on the first side of the center plane. It is only necessary that the forward pair and rearward pair be along lines substantially perpendicular to the center plane of the housing so as to form mechanical retention pairs as described hereinafter. Consider the lug identified by numeral 164 in FIG. 6. Lug 164 is bowed outwardly between the bottom wall 46 of housing 12 and end 186. Preferably, lug 164 is bent outwardly at line 188 which is slightly above the bottom 190 of circuit board 47. Somewhat below the likely location of bottom 190 of circuit board 47, lug 164 is bent inwardly, such as at line 192. Preferably, the outward incline of lug 164 between 188 and 192 is greater than the inward incline between 192 and 186 as compared to the plane of mid-portion 80.

Lug 164 and the lug identified by numeral 144 are directly opposite from one another and form a retention pair. Since both lugs are bowed outwardly from the center plane of jack 10, each contacts the lower outer edge of the openings 194 in the circuit board so as to hold the jack to the circuit board. More particularly, the lugs apply a small spring force against the lower portion of the circuit board to pull standoffs 44 against the top of the circuit board. The present lug configuration advantageously allows for the jack to be inserted into the circuit board rather easily, but requires greater force to pull the jack from the board. This results from the smaller incline of the lug between 186 and 192 and than between 192 and 188. A further advantage of the present configuration is that there is a perceptible feel, and even an auditory result, when jack 10 is inserted into the circuit board as points 192 egress from the circuit board openings.

In use, the lugs 78 of a jack 10 are inserted into the hole pattern on a circuit board 47. The jack 10 is simply pressed against the circuit board so that the lugs from opposite sides of the center plane bend inwardly toward one another before snapping outwardly as points 192 pass through the circuit board. The outward snapping not only may be auditory, but results in a pulling of the jack to the board thereby providing a certain feel to the person inserting the jack. Each of the various lugs is likely aligned with a circuit path and each is likely soldered to that particular path at the bottom of the board. A primary advantage of the retention pairs to to hold the jack firm with respect to the board before and during a mass production flow solder operation.

Cover 30 is installed over jack 10 by inserting tongue 96 in groove 94 and pressing cover 30 downwardly against housing 12 until loop 112 fits over block 114.

A lower plug 18 may then be inserted in lower passage 16. Ball 66 and ring 60 contact portions 152 of lower ball spring 120 and lower ring spring 116, respectively. Each spring is bent about vertical and horizontal axes to provide an adequate force to keep contact portions 152 pressed firmly against ball 66 and ring 60. With plug 18 inserted, contactors 142 and 154 of each of switch pairs 22 and 24 separate to open the switches. In making the opening movement, each contactor slides with respect to the other to accomplish a cleaning function.

Lower spring element 76 of sleeve spring 20 at contact portion 86 provides electrical continuity with sleeve 52. In a similar fashion, an upper plug 18 may be inserted in upper passage 14 to open switching pairs 26 and 28 while making electrical contact at contact portion 84 of spring element 74 of sleeve spring 20.

Jack 10 may be disassembled by reversing the above discussed steps.

Thus, jack 10 has been described in detail and numerous advantages have been set forth. Nevertheless, the preferred embodiment shown and described is exemplary and, it is understood, that changes may be made. Equivalent changes, however, especially in matters of shape, size and arrangement, to the full extent extended by the general meaning of the terms in which the appended claims are expressed, as indicated previously, are understood to be within the principle of the present invention.

What is claimed is:

1. An electrical jack for receiving electrical plugs, said jack for use on a circuit board, said jack comprising:

a non-conductive housing having a center plane and a bottom wall, said bottom wall being substantially parallel with said circuit board when said housing is attached to said circuit board, said center plane being substantially perpendicular to said bottom wall, said housing further having a plurality of means for receiving a plug, each of said receiving means having an axis substantially parallel to said bottom wall, said plurality of receiving means being stacked and having said axes in the center plane of said housing; and spring means for providing continuity between conductive paths on said circuit board and said plugs; and means for fastening said spring means to said housing.

2. The jack in accordance with claim 1 wherein said spring means includes means for grounding each of said plugs received in each of said receiving means and means for switching between circuit paths on insertion and retraction of one of said plugs, said grounding means including a sleeve spring having attached thereto a common lug and a spring element operable for each said plug received in each of said receiving means.

3. The jack in accordance with claim 2 wherein said fastening means includes means for retaining said sleeve spring, said retaining means including a pair of spaced-apart, facing grooves formed on a sidewall of said housing, said grooves providing a pocket for supporting said sleeve spring on operation of said spring elements.

4. The jack in accordance with claim 1 wherein said spring means includes a pair of springs, said springs having lug portions with means for requiring greater force to remove said jack from said circuit board than to insert said jack into said circuit board.

5. The jack in accordance with claim 4 wherein said circuit board includes a pattern of openings for receiving the lug portions of said springs of said spring means, each said lug portion having an end, wherein each said pair of said springs forms a retention pair, each said retention pair forming a line substantially perpendicular to the center plane of said housing, one of said springs of each retention pair being on an opposite side of said center plane as the other, and wherein said force requiring means includes said lug portions between said ends and the bottom wall of said housing having portions bowed outwardly with respect to said center plane, said bowed portions having expansion portions where said lug portions are inclined away from said center plane and contraction portions where said lug portions are inclined toward said center plane as viewed from the ends of said lug portions, said expansion portions being inclined greater than said contraction portions thereby requiring greater force for removal than for insertion.

6. The jack in accordance with claim 1 including a cover having means for attaching to said housing, said cover enclosing in combination with said housing said spring means thereby shielding said spring means from dust, said cover attaching means including a tongue on said cover and a groove on said housing for engagement at a first end of said combination, said groove being perpendicular to the bottom wall of said housing, said cover attaching means including a loop on said cover and a block on said housing for engagement at a second end of said combination.

7. An electrical jack for receiving upper and lower electrical plugs, said jack for use on a circuit board, said jack comprising:

a non-conductive housing having a center plane, said center plane being approximately perpendicular to said circuit board when said jack is installed on said circuit board, said housing having upper and lower passages for supporting said upper and lower plugs, each of said upper and lower passages being centered on said center plane and being oriented with an axis approximately parallel to said circuit board when said jack is installed on said circuit board;

spring means for providing continuity between conductive paths on said circuit board and said upper and lower plugs, said spring means including first and second means for switching with said upper plug and third and fourth means for switching with said lower plug, said first and second switching means being located on one side of said center plane and said third and fourth switching means being located on the other side; and means for fastening said spring means to said housing.

8. The jack in accordance with claim 7 wherein said plugs include tip, ring and sleeve portions and wherein said first switching means includes a lower ring spring and a first normal spring, said second switching means includes a lower tip spring and a second normal spring, said third switching means includes an upper ring spring and a second normal spring, and said fourth switching means includes an upper tip spring and a first normal spring, said first normal spring for said first and fourth switching means being the same, said second normal spring for said second and third switching means being the same.

9. The jack in accordance with claim 7 wherein said first, second, third and fourth switching means each includes springs having contactors, said contactors being approximately centered with respect to a contactor plane, said contactor plane being approximately perpendicular to said center plane.

10. The jack in accordance with claim 9 wherein each of said first and second switching means includes first and second means for contacting said lower plug on insertion and retraction, said first and second contacting means being located beneath said contactor plane, and wherein each of said third and fourth switching means includes third and fourth means for contacting said upper plug on insertion and retraction, said third and fourth contacting means being located above said contactor plane.

11. An electrical jack for receiving electrical plugs, said jack for use on a circuit board, said jack comprising:

a non-conductive housing having a center plane, said center plane being approximately perpendicular to said circuit board when said jack is installed on said circuit board, said housing including upper and lower means for receiving said plugs, said upper and lower receiving means being centered on said center plane and being oriented with an axis for each of said receiving means approximately parallel to said circuit board when said jack is installed on said circuit board;

spring means for providing continuity between conductive paths on said circuit board and said plugs, said spring means including switching pairs of springs on opposite sides of said center plane, a first said spring of a first said switching pair on a first side of said center plane forming a mechanical circuit board retention pair with a second said spring of a second said switching pair on a second side of said center plane; and means for fastening said springs of said spring means to said housing.

12. Apparatus, in combination, comprising:

a housing;

a switching contactor for contacting a first electrical circuit element having a mating contactor;

a spring made from a strip of conducting material, said switching contactor being attached to said spring, said spring for forming a conductive path between a second electrical circuit element and one of said switching contactor and a plug; and means for fastening said spring to said housing, said fastening means having a center line;

said spring including means for bending in torsion about said center line and a direction non-parallel to said center line, said bending means including means for contacting said plug in space generally between said fastening means and said switching contactor, said bending means including a cantilever portion of said strip extending away from said fastening means, said cantilever portion being formed to have a greater portion on a first side of the center line, said bending means further including a connecting portion between said cantilever portion and said plug contacting means, said plug contacting means being on a second side of the center line, whereby when said contacting means is contacted by said plug, said cantilever portion bends with respect to said fastening means and said connecting means bends with respect to said cantilever portion.

13. An electrical jack for receiving upper and lower electrical plugs, said plugs having axes and tip, ring, and sleeve portions, said jack for use in a circuit board, said jack comprising:

a non-conductive housing having a center plane and a base with a bottom wall, said center plane being substantially perpendicular to said bottom wall, said housing further having front and rear structures rising above said base, said front structure having upper and lower cylindrical passages centered on said center plane;

a sleeve spring having a frame with upper and lower spring elements cantilevered therefrom, said sleeve spring further having a lug attached to said frame, said front structure of said housing including along one side a pair of spaced-apart, facing grooves forming a pocket for receiving said sleeve spring, said grounding lug extending beneath said bottom wall of said housing, said housing having upper and lower openings through which said upper and lower spring elements pass to contact said upper and lower plugs;

spring means for providing continuity between conductive paths on said circuit board and said upper and lower plugs, said spring means including first and second means for switching with said lower plug and third and fourth means for switching with said upper plug, said first and second switching means being located on one side of said center plane and said third and fourth switching means being located on a second side of said center plane, said first, second, third and fourth switching means each including a normal spring and a contacting spring, all said springs having contactors, said contactors being approximately centered on a contactor plane, said contactor plane being approximately parallel with the bottom wall of said housing, said contacting springs including means for contacting one of said upper and lower plugs, said contacting means for said first and second switching means being located beneath said contactor plane, said contacting means for said third and fourth switching means being located above said contactor plane, one of said normal springs adjacent to said front structure and one of said normal springs on the opposite side of said center plane adjacent to said rear structure being identical, said spring means including means for holding said jack to said circuit board after insertion of said jack on said circuit board; and means for fastening said springs to said housing.

* * * * *